United States Patent [19]

Spence

[11] 4,198,843

[45] Apr. 22, 1980

[54] PROCESS FOR PRODUCING TUBULAR ARTICLES

[76] Inventor: Geoffrey M. Spence, Jugglers, Folly Lane, Crowborough, Sussex, England

[21] Appl. No.: 922,328

[22] Filed: Jul. 6, 1978

[30] Foreign Application Priority Data

Jul. 7, 1977 [GB] United Kingdom ..... 28495/77

[51] Int. Cl.[2] ..... B21D 22/00

[52] U.S. Cl. ..... 72/356; 29/1.31; 72/360; 72/370

[58] Field of Search ..... 72/354, 356, 359, 360, 72/370; 29/1.3, 1.31

[56] References Cited

U.S. PATENT DOCUMENTS

| | | | |
|---|---|---|---|
| 2,089,912 | 8/1937 | Bignelli | 29/1.31 |
| 2,394,842 | 2/1946 | Catlin et al. | 72/354 |
| 2,397,206 | 3/1946 | Ryan | 72/370 X |
| 2,980,993 | 4/1961 | Lyon | 72/370 X |
| 3,456,479 | 7/1969 | Matveev | 72/370 X |
| 3,948,073 | 4/1976 | Levell | 72/356 X |
| 4,068,518 | 1/1978 | Dockerill | 72/354 |

FOREIGN PATENT DOCUMENTS

| | | |
|---|---|---|
| 514800 | 10/1952 | Belgium . |
| 893936 | 10/1953 | Fed. Rep. of Germany . |
| 178286 | 9/1935 | Switzerland . |
| 779730 | 7/1957 | United Kingdom . |
| 931768 | 7/1963 | United Kingdom . |

*Primary Examiner*—Leon Gilden
*Attorney, Agent, or Firm*—William E. Jackson

[57] ABSTRACT

A cold working process for the manufacture of a hollow tubular metal article having a shaped head, the process comprising: (a) supporting an open-ended hollow metal tube on a first forming tool with one end of the tube projecting beyond the end of the tool, (b) initially necking the projecting end of the tube in a necking die, and thereafter, with the necked tube held in the die by the first forming tool, (c) compressing the necked portion of the tube between the first forming tool and a second forming tool to form the shaped head.

11 Claims, 4 Drawing Figures

Fig 1
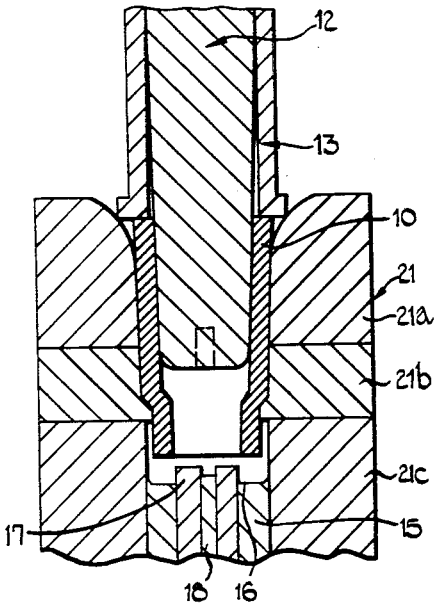
Fig 2
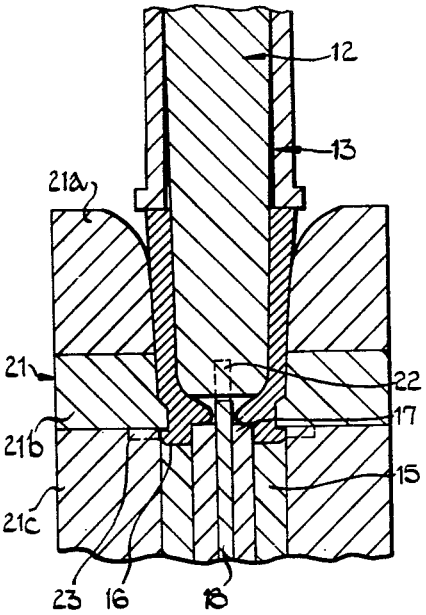
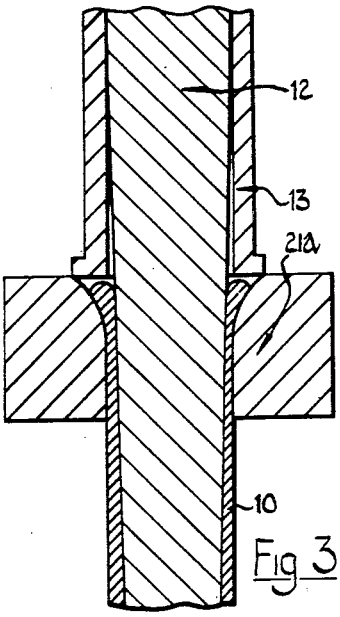
Fig 3
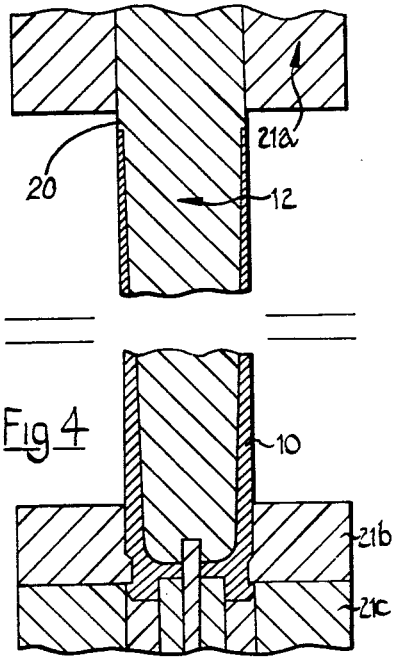
Fig 4

PROCESS FOR PRODUCING TUBULAR ARTICLES

This invention relates generally to a process for producing tubular articles which are closed or partially closed at one end to form a tubular vessel or container. The invention is particularly concerned with a process for the manufacture of shell and cartridge cases.

A known process for the manufacture of shell and cartridge cases consists of stamping a disc from a brass sheet, forming the disc into a tube closed at one end, progressively drawing the tube to the required length, stamping a primer pocket in the base of the tube, and finally drilling a hole through the base of the tube, the drilled hole communicating with the pocket to form a primer vent. Such a process involves several different operations and is therefore time consuming and relatively expensive. Moreover, the tube is extended to three or four times its original length and it must therefore be annealed during the drawing process.

In accordance with the present invention a process for the manufacture of a tubular metal container or vessel comprises mounting an open-ended metal tube on a first forming tool and relatively moving the first forming tool and a second forming tool such that the metal at one end of the tube is displaced inwardly around the circumference of the tube to close or partially close that end of the tube.

When forming a shell or cartridge case by a process embodying the invention, the inwardly displaced metal forms a central hole at the said end of the tube and the relative movement of the forming tools simultaneously forms an external recess or pocket in the displaced metal, the recess or pocket communicating with the said hole.

In a preferred embodiment of the invention the tube is mounted on a mandrel and the second forming tool consists of a die and a punch.

By way of example only, a process embodying the invention will now be described with reference to the accompanying drawings in which:

FIGS. 1–4 represent diagrammatically a sequence of steps in the formation of a cartridge case.

Referring first to FIG. 1, an annealed brass tube 10 is shown inserted into a three-part die 21. The tube 10 is mounted on a spring loaded mandrel 12. A sleeve 13 surrounding the mandrel 12 is provided with an outer collar (not shown) which prevents the wall of the tube 10 deforming as the tube is progressively necked in the die parts 21*a* and 21*b*.

The die part 21*c* has a punch 15 slidably received therein. The face 16 of the punch 15 includes an annular projection 17 having an outer diameter substantially equal to the internal diameter of the necked portion of the tube 10. A pin 18 is slidably received in the central hole of the projection 17.

Once the tube 10 has been necked as shown in FIG. 1, the next step in the process is shown in FIG. 2. The mandrel 12 and the punch 15 are moved toward one another with the pin 18 locked in a position portruding above the annular projection 17. As the punch 15 engages the necked portion of the tube 10, the metal of the tube 10 is displaced inwardly through substantially 90°. This is the only space available into which the metal can flow when compressed between the mandrel 12 and the surface 16 of the punch 15. The pin 18 finally enters the hole 22 in the mandrel 12 as shown in FIG. 4. The resulting distribution of metal at the bottom of the tube 10 provides a base which includes a recess or pocket having a shape corresponding to the projection 17 and which further includes a hole corresponding to the shape of the pin 18, this hole communicating with the recess and being positioned centrally thereof.

The pocket thus forms the conventional primer pocket for receiving a primer charge when the tube 10 has been drawn and filled with a propellant mixture for the cartridge projectile.

The tube 10 is drawn to about two or three times its length by means of the swaging die 21*a* as shown in FIGS. 3 and 4. In these figures the angles of the swaging work faces are exaggerated. The final motion of the swaging die 21*a* over the shoulder 20 of the mandrel 12 automatically trims the tube 10 to the required length.

If it is required to form the head of the cartridge with an external projecting rim or flange (such cartridges being known as "rimmed" cartridges), the die 14 is recessed as shown in dashed outline in FIG. 2, and the mandrel is displaced an extra distance. This additional movement of the mandrel displaces metal into the recess 23 and thus forms the projecting rim.

The required variation in wall thickness for a particular case can, if the case is short, be provided by the final motion of the die. Larger cases may be swaged by reverse motion of the die.

The manufacture of a shell case can usually be accomplished with a single die in a one stage operation. However, for a case of bottle-neck design, a second die is used to neck and trim the case to the correct length.

I claim:

1. A cold working process for the manufacture of a hollow tubular metal article having a shaped head, the process comprising: (a) supporting an open-ended hollow metal tube on a first forming tool with one end of the tube projecting beyond the end of the tool, (b) initially necking the projecting end of the tube in a necking die, and thereafter, with the necked tube held in the die by the first forming tool, (c) compressing the necked portion of the tube between the first forming tool and a second forming tool to form the shaped head.

2. A process according to claim 1 further comprising inserting a portion of the second forming tool into the mouth of the necked tube before compressing the necked portion of the tube between the two tools.

3. A method according to claim 2 in which the said portion of the second forming tool is substantially circular and projects from an end face of the tool, the diameter of the circular projection being substantially equal to the internal diameter of the necked portion of the tube.

4. A process according to claim 3 in which the circular projection is surrounded by an annular portion of the said end face which subsequently engages the end face of the necked tube during the compression of the said necked portion between the two tools.

5. A process according to claim 1 in which the die is separable into at least two parts, the necking of the tube being performed in a first of the said parts, and in which, after forming the said head, a second part of the die is moved relative to the first forming tool to draw the tube to its required length.

6. A cold working process according to claim 5 in which the necking of the tube and the shaping of the head are performed in the first of the die parts by moving the two forming tools toward one another in a first working stroke, and in which the said movement of the second part of the die to draw the tube provides a second working stroke whereby the complete article is formed in a single die and in a continuous two-stroke operation.

7. A cold working process according to claim 5 in which the first forming tool is tapered toward the end of the tool supporting the tube such that the said relative movement between the first forming tool and the second part of the die swages thetube and produces a progressively decreasing sectional thickness.

8. A cold working process according to claim 1 in which the second forming tool is slidable in a bore formed in the said die, the two forming tools being disposed on opposite sides of the necking portion of the die, and the bore having a diameter substantially equal to the diameter of the tube prior to the necking thereof.

9. A cold working process according to claim 8 in which the bore is recessed beneath the necking portion of the die in such a manner that metal is displaced into the recess during compression of the necked portion of the tube between the two forming tools whereby the head of the article is further provided with a projection rim or flange.

10. A cold working process for the manufacture of a tubular metal shell or cartridge case, the process comprising: (a) supporting an open-ended hollow metal tube on a first forming tool with one end of the tube projecting beyond the end of the tool in a die, (b) initially necking the projecting end of the tube in a necking die and thereafter, with the necked tube held in the die by the first forming tool, (c) compresssing the necked portion of the tube between the first forming tool and a second forming tool to form the head of the shell or cartridge case with a primer pocket and vent.

11. A cold working process for the manufacture of a hollow tubular metal article having a shaped head, the process comprising: (a) supporting and open-ended hollow metal tube on a mandrel with one end of the tube projecting beyond the end of the mandrel, the mandrel being surrounded by a spring-loaded sleeve which engages the end face of the tube, (b) inserting the mandrel into a die such that the projecting end of the tube is necked in a necking portion of the die, (c) advancing a second forming tool toward the first forming tool, the second forming tool being slidably received in a bore formed in the die beneath the necking portion thereof, the advancing end face of the second tool having a substantially circular projecting portion with a diameter substantially equal to the internal diameeer of the necked portion of the tube, (d) the said projecting portion being inserted into the mouth of the necked portion of the tube before an annular portion of the said end face surrounding the circular projection engages the end face of the necked tube to compress the necked portion of the tube between the two tools and thereby form the shaped head.

* * * * *